US005819506A

United States Patent [19]

Frabetti et al.

[11] Patent Number: 5,819,506

[45] Date of Patent: Oct. 13, 1998

[54] METHOD AND APPARATUS FOR CLOSING THE EDGES OF WRAPPING MATERIAL

[75] Inventors: Fabio Frabetti, Bologna; Marco Giovanni Carle, Milan, both of Italy

[73] Assignee: Carle & Montanari S.p.A., Bologna, Italy

[21] Appl. No.: 742,948

[22] Filed: Nov. 1, 1996

[30] Foreign Application Priority Data

Nov. 10, 1995 [IT] Italy ..... B095A0528

[51] Int. Cl.[6] ..... B65B 11/42

[52] U.S. Cl. ..... 53/466; 53/230; 53/234

[58] Field of Search ..... 53/466, 464, 461, 53/228, 234, 232, 231, 230, 223, 225, 224

[56] References Cited

U.S. PATENT DOCUMENTS

| | | | |
|---|---|---|---|
| 3,338,024 | 8/1967 | Maulini | 53/223 X |
| 4,085,567 | 4/1978 | Putnam, Jr. et al. | 53/225 |
| 4,995,223 | 2/1991 | Spatafora et al. | 53/234 X |
| 5,271,205 | 12/1993 | Spatafora et al. | 53/225 X |

FOREIGN PATENT DOCUMENTS

| | | |
|---|---|---|
| 111050 | 8/1925 | Switzerland . |
| 353642 | 7/1931 | United Kingdom . |

*Primary Examiner*—James F. Coan
*Attorney, Agent, or Firm*—Larson & Taylor

[57] ABSTRACT

The closing of the end edges of the wrapper (5) which is wrapped around the product in a shape made tubular in a known manner, is performed by folders, some of which are dynamic (15, 15' and 17, 17' ), located in different stations, and some static (8, 8' and 18, 18'). The first pair of dynamic folders (15, 15') is mounted on the same dynamic folder (14) that folds the first lateral edge (505) of the wrapper. A possible option is to replace the last pair of dynamic folders (17, 17') with a pair of static folders (25, 25'). Before the final rolling stage, the wrapped product passes through a shaped channel (19) that keeps the end folds of the wrapper correctly arranged. The last pair of static folders (18, 18') may be incorporated in this channel. The end edges of the wrapper may be folded in three or in four consecutive portions laid over each other.

28 Claims, 6 Drawing Sheets

METHOD AND APPARATUS FOR CLOSING THE EDGES OF WRAPPING MATERIAL

The invention relates to a method and a corresponding apparatus, of simplified construction, for closing the edges of wrapping material for chocolates or other products having similar requirements, especially for spheroidal or ovoid products that may or may not require a final rolling stage. The invention also concerns the wrapper closed by the new method.

Current wrapping machines, as for example those described in patent application No. B095A000165 in the CARLE & MONTANARI of Bologna, Italy name, include means for the cyclic positioning of each product with its wrapper between a lifter and a complementary lifter, which grip the product with its wrapper, raise it and transfer it to one of the pincers of a hub that rotates about a horizontal axis, with angular movements or steps of ninety degrees or of some other angle. During the raising stage, the wrapper and the product pass through a fixed folder which folds down two of the opposite edges of the wrapper, giving the latter an upturned "U" profile. Currently, in this condition, the product and wrapper are together taken by the pincer and acted upon by a folder which oscillates on the axis of the hub of the pincers, which folds one of the edges of the wrapper and gives the latter an approximate "p" profile. In the next stage, the hub with the pincers rotates one step and removes the product with the wrapper from the aforesaid oscillating folder, causing the other edge of the wrapper to interfere with a fixed arcuate folder, which makes the wrapper into a tube. After rotating one step, the pincer with its partially wrapped product stops, and four folders act on each end of the wrapper, the respective movements of these folders being synchronized with each other suitably: the folders fold four end portions of the wrapper in succession over each other and in opposite pairs. The hub with the pincers then turns another step and the product enclosed in the wrapper arrives at a lifting device which, in phase with the opening of the pincers in which the product was held, lifts this wrapped product and places it in contact with a belt which then rolls it along inside a straight channel, so that the wrapper is made to cling closely and uniformly to the product.

The apparatus considered above has the disadvantage of the presence of fully four dynamic folders operating in a single station where the product and its wrapper are stationary. This makes for constructional complexity in the drives of said folders and causes a problem in that the lengths of time taken by the folders to perform their tasks are added to each other and inevitably affect the amount of time the hub with its pincers is stationary and hence affect the entire product wrapping cycle.

The invention seeks to overcome these dis-advantages with the following concept. Once the product with its wrapper is raised, after the wrapper has been acted on by the forked folder and the product with this wrapper has been gripped laterally by the pincer, the dynamic lateral folder intervenes and creates, in a known manner, the "p" profile of the wrapper. According to the invention, another pair of folders is mounted on this dynamic folder and folds an initial portion of the end edges of the wrapper. Next, as the hub with the grippers rotates one step, the product with the wrapper is acted on by the known arcuate folder, which closes the wrapper laterally, and, after said rotation, another pair of suitably shaped folders folds a second portion of the end edges of the wrapper. During the next step of rotation of the hub with the grippers, a third and last portion of the end edges of the wrapper is folded around the product by the action of a last pair of static folders, and the wrapped product finally reaches the upper station from which it will then be transferred to the final rolling apparatus. During its transfer to said upper station, the product with the wrapper travels preferably through an arcuate channel that keeps the end edges of the wrapper properly folded and laid over each other.

Of the five dynamic folders necessary in the prior art, counting also the one that operates in the first station at the bottom where the pincer is stationary, the solution according to the invention uses only two, which operate in different stations so that the lengths of time they each take to perform their tasks do not add up as in the prior art. This has advantages in simplifying the construction of the machine, reducing the length of time the hub and pincers are stationary and the total length of time of the product wrapping cycle, or, for the same amount of stationary time, makes it possible to spend longer on the folding stages and thus improve the quality of the folds of the wrapper.

The invention also includes alternative embodiments in which the second pair of dynamic folders is replaced by static folders, or in which the end edges of the wrapper are folded in four successive portions rather than in three as stated earlier. Initial portions of the end edges of the wrapper are folded by a pair of static folders that operate during the stage in which the product is raised with the wrapper and the two are transferred to the gripping pincer.

Other features of the invention and the advantages that flow therefrom will become clear in the following description of certain preferred embodiments of the same. These are illustrated purely by way of non-restrictive example in the figures of the six attached sheets of drawings, in which:

FIG. 1 a diagrammatic view in perspective of the apparatus to which the preferred embodiment relates;

Figure 1:
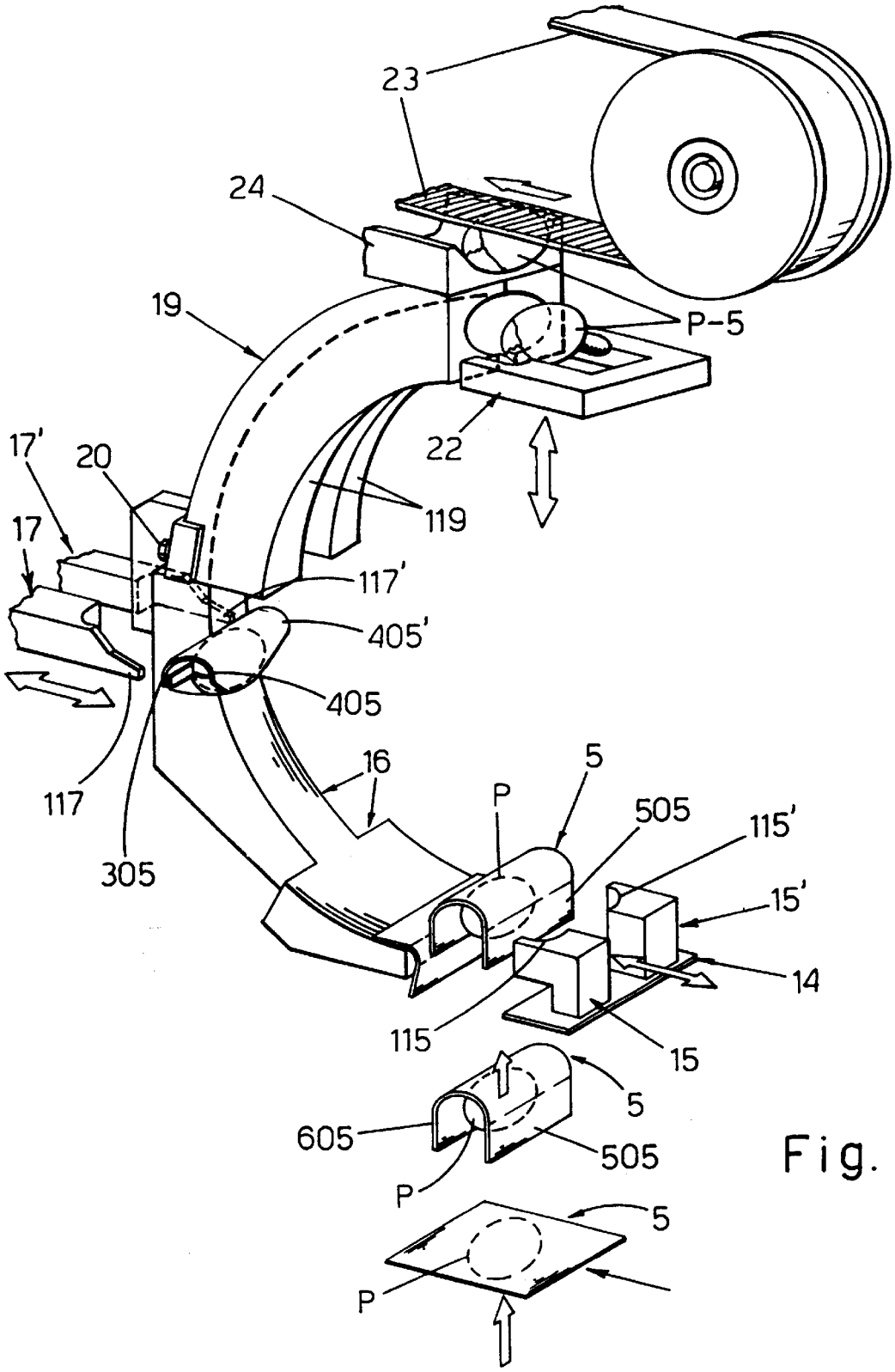
Figure 3:
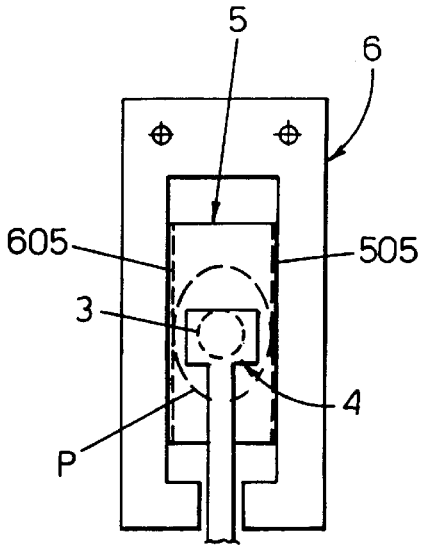
FIG. 3 is a plan view from above of the same components as in FIG. 2.
Figure 2:
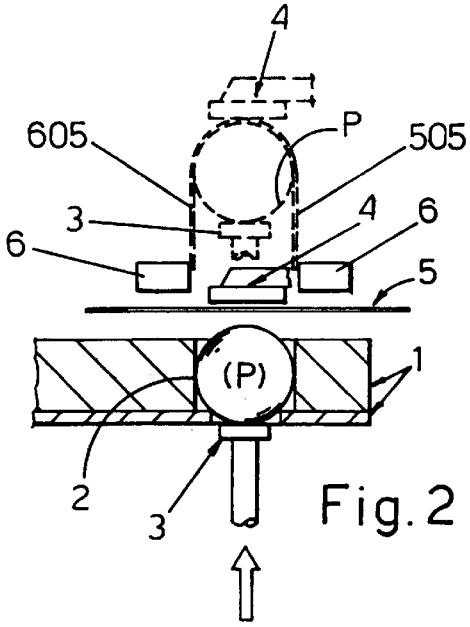
FIG. 2 is a side view with parts in section of the means for feeding the product to the first station of the apparatus and of the stage in which the product and its wrapper are raised.
Figure 14:
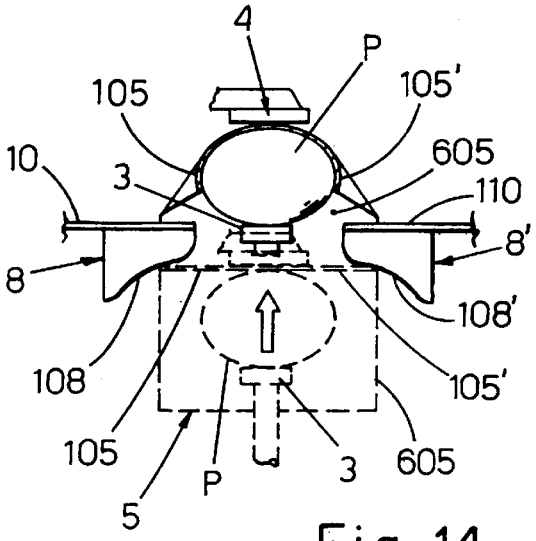
FIG. 14 is a front elevation of the pair of static folders of the station shown in FIG. 12.

In FIGS. 1 and 2 it can be seen that the product P to be wrapped is fed by any suitable means to a wrapping station, e.g. by a disc of known type 1 with peripheral sockets 2 in which the products are carried. In this station, the product is positioned between a lifter 3 and a complementary lifter 4 of known type, while other known means, not illustrated, place the wrapping material or wrapper 5 above the product. The product and the wrapping material are held together by the lifter 3 and complementary lifter 4 which rise, the wrapper interfering with an optional fixed folder 6, forming a ring as in FIGS. 2 and 3, which folds down two opposite edges 505, 605 of the wrapper, which becomes like an upturned "U". After being acted on by the folder 6, the partially wrapped product is gripped laterally by the jaws of the known pincer 107 while the complementary lifter 4 withdraws and the lifter 3 returns to the down position for the next work cycle.

Figure 4:
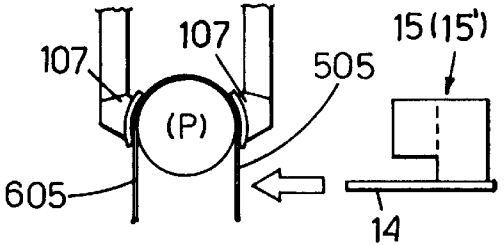
FIGS. 4 and 5 are lateral elevations, at rest and active, of the dynamic composite folder that operates in the first process station of the apparatus to fold the wrapper into a "p" and to fold an initial pair of end portions of the wrapper.
Figure 5:
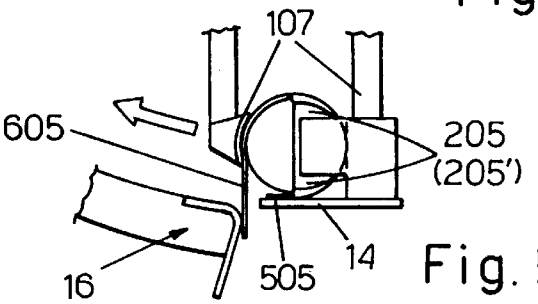

In FIGS. 1, 4 and 5, the numeral 14 denotes the known folder actuated by rectilinear actuators or mounted on an arm oscillating about the axis of the rotating hub with the pincers 107, which in response to a signal advances in a known manner under the product P so as to fold the edge 505 of the wrapper underneath it, as shown in FIG. 5. Mounted on the folder 14 are two opposing folders 15, 15' that fold end portions 205, 205' of the wrapper around the ends of the product. The active surface 115, 115' of each folder 15, 15' has a shape determined by the shape of that end of the product, in order that the folded portions of the wrapper are caused to cling closely to the product.

While the composite folder 14, 15, 15' remains in the active position, the hub 7 with the pincers 107 rotates one step clockwise, when viewing the drawings, in such a way that the edge 605 of the wrapper is acted on by the end of a fixed arcuate folder of known type 16, causing the wrapper to encircle the product in a tubular configuration, already folded around a portion of each end as discussed above.

Figure 6:
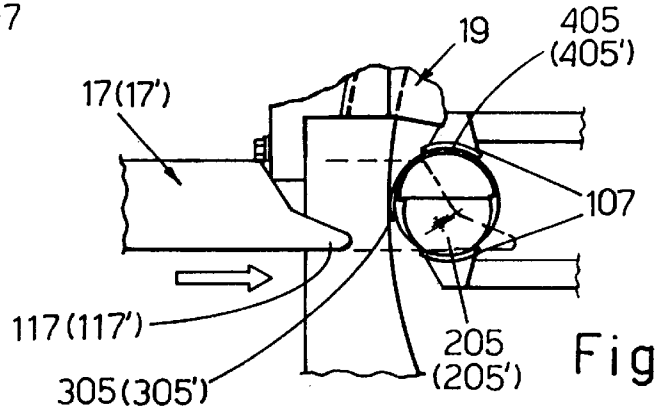
FIG. 6 is a lateral elevation of the second process station of the apparatus.
Figure 9:
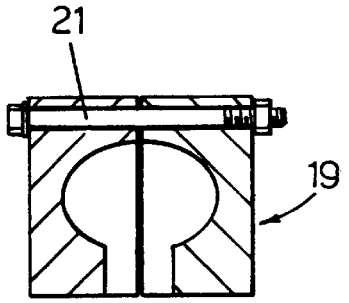
FIG. 9 shows the channel of FIG. 8 in transverse section.

In FIGS. 1 and 6 it can be seen that when the pincer 107 has turned one step and halted, a pair of dynamic folders 17, 17' is actuated by a rectilinear actuator or by an oscillating system or other-known means so that their suitably shaped ends 117, 117' fold further end portions 305, 305' of the wrapper around the ends of the product. The ends 117, 117' of the folders, 17, 17' have any suitable shape that will cause the folded portions of the wrapper to cling closely to the ends of the product and that will allow the same folders to remain stationary in the advanced position after forming the fold, while the pincer 107 sets off on the next step of rotation, carrying away from said folders the product with the wrapper, which remains correctly arranged. While the product and the wrapper move away from the influence of the folders 17, 17', which then return to rest, the last end portions 405, 405' of the wrapper are folded over the previously folded wrapper portions 305, 305' by a pair of static folders 18, 18' which are preferably incorporated in a stationary arcuate channel 19 (see below). This is made of a suitable material having a low coefficient of friction, its walls 119 act on the ends of the wrapper to keep them correctly arranged, and it is fixed at one end, at 20, to the arcuate folder 16 and at the other end, at 120, to the straight rolling channel 24 mentioned earlier. FIG. 9 shows that the arcuate channel 19 is formed from two identical but symmetrically opposite parts bolted together with bolt 21 and made by cutting transversely a single ring machined on one face. The internal profile of the channel 19 is such as to form a "C" that circumscribes as much as possible the wrapped product and is open to allow the legs of the pincers 107 to pass through.

In an alternative embodiment, not illustrated, the parts making up the channel 19 may be fastened to each other and/or to supporting means, with suitable elastic means interposed, in order to ensure the desired frictional action of the channel on the wrapped product.

Figure 7:
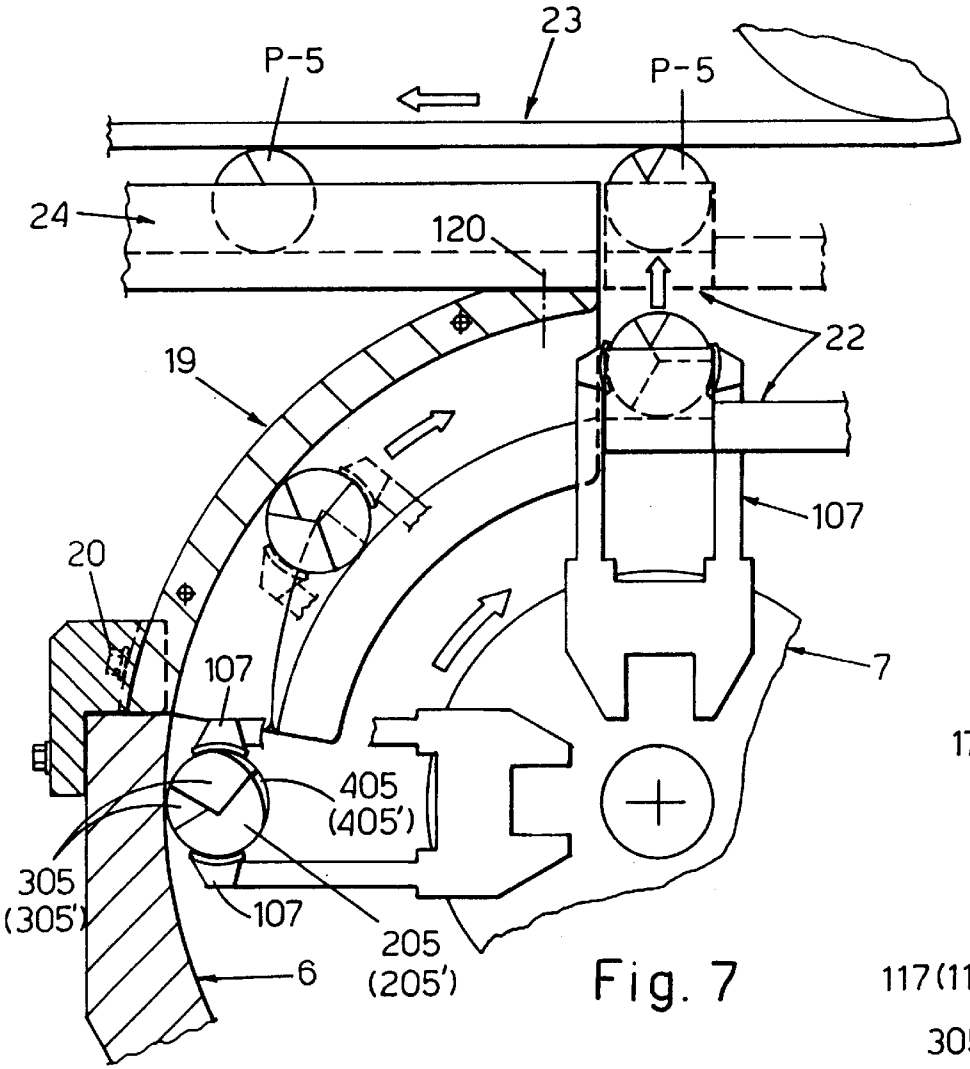
FIG. 7 is a lateral elevation with parts in section of the second and third process stations of the apparatus.
Figure 8:
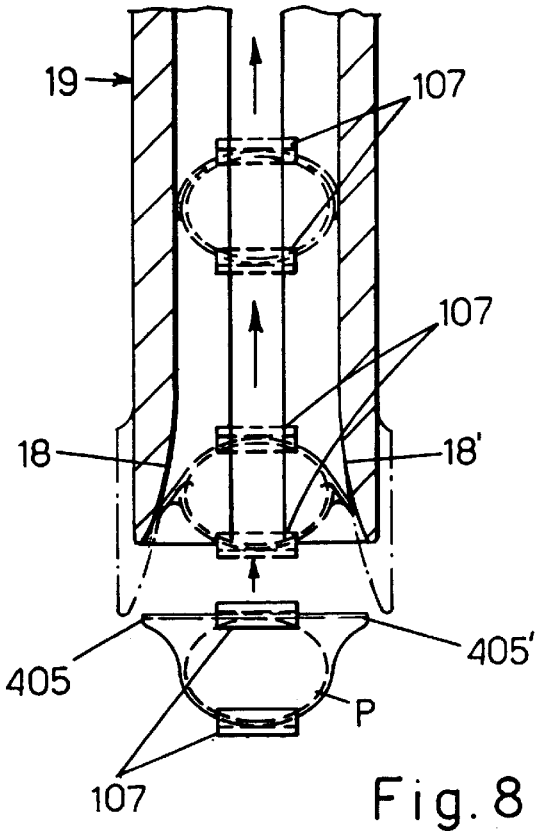
Fig. 8 shows in longitudinal section the channel that concludes the folding of the end edges of the wrapper on its journey from the second to the third process stations.

The channel 19 is such as to leave the product free when it reaches the vertical position of FIG. 7, above a known type of lifter 22 designed to support the wrapped product by its ends and which, when the pincers 107 have opened, raises the product, as indicted by the dashed lines, into contact with the underside of a belt, also known, 23 which rolls the product out of the lifter and along an adjacent horizontal channel 24, also known, in which the known stage of rolling is carried out, the purpose being to cause the wrapper to cling closely and uniformly to the product. The terminal end of the arcuate channel 19 and the starting end of the straight channel 24 preferably lie in a single vertical plane that acts as a guide as the product is being raised by the lifter 22. This flat surface may be shaped differently so as partly to marry the convexity of the raised product, or, in an alternative form not illustrated, the product may be conveniently guided by suitable means while being raised.

Figure 10:
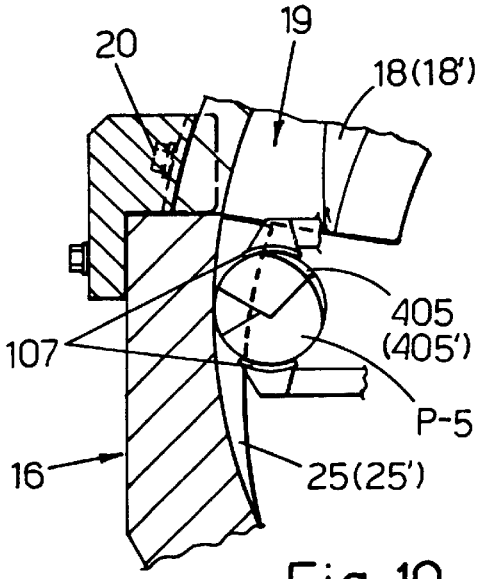
FIG. 10 is a side view with parts in section of the second process station of the apparatus, without the pair of dynamic folders and having static folders instead.
Figure 11:
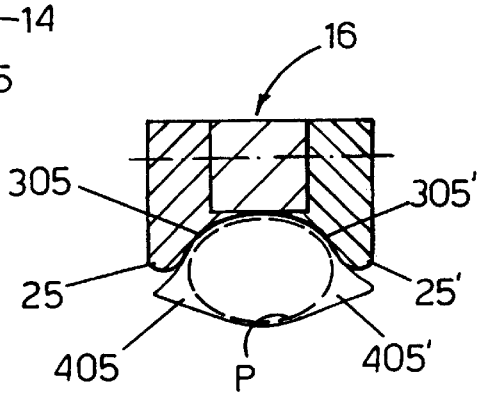
FIG.11 is a transverse section through the second process station of the apparatus as in FIG. 10.

In FIGS. 10 and 11 it can be seen that, in an alternative embodiment of the invention, the pair of movable folders 17, 17' can be removed and replaced by a pair of static folders 25, 25' fixed laterally to the end part of the arcuate folder 16 and followed by suitable internal shaping of the arcuate channel 19, in such a way as to perform a partial folding of the end portions 305, 305' of the edges of the wrapper, subsequently completed by the laying over and folding down of the last portion of each edge 405, 405' as stated earlier.

Figure 12:
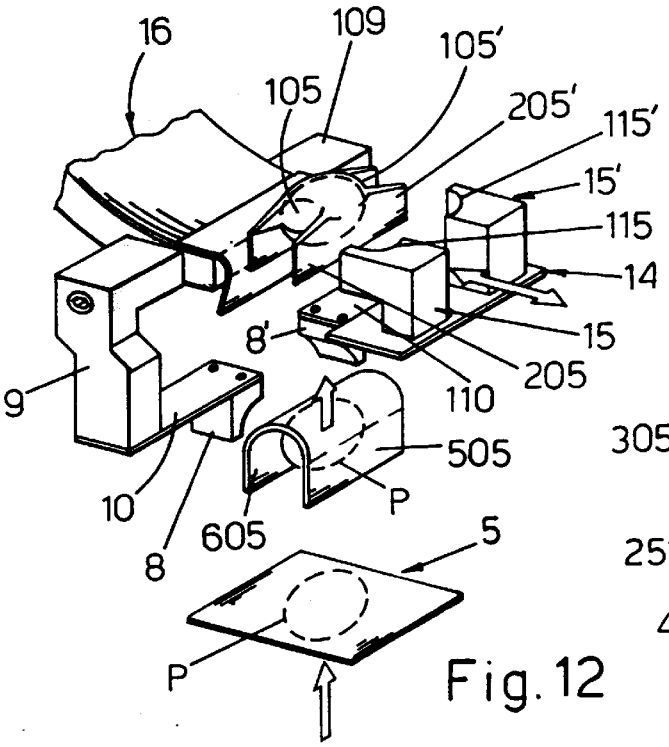
FIG. 12 is a perspective view of an alternative embodiment of the first process station of the apparatus, is in which two portions of the end edges of the wrapper are folded in succession.

With reference to FIG. 12, a description will now be given of another alternative embodiment of the apparatus which, using the same movable folders as described above and another pair of static folders, folds the end edges of the wrapper in four parts, rather than in three as in the previous case.

Figure 13:
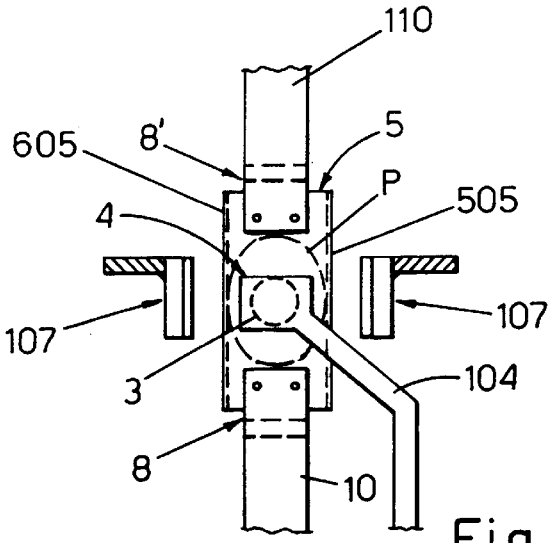
FIG. 13 is a top view of the modified station as in FIG. 12.

FIGS. 2, 12 and 13 show the complementary lifter 4 connected to its supporting and controlling post, not shown, by means of an arm 104 that is wholly or partly oblique so as not to interfere with the already-mentioned folder 6, with the jaws of the pincer 107 located above it and with a pair of static and opposing folders 8, 8' arranged above said folder 6 and designed to interfere with the curved ends of the wrapper projecting from the product P, in such a way as to fold down a first central portion 105, 105' of these, but without interfering with the product. The active surfaces 108, 108' of the folders 8, 8', which touch and fold the ends of the wrapper, are inclined to form an acute angle in their intersection with the imaginary horizontal plane containing the wrapper portions to be folded and their ends are rounded in some suitable way. The folders 8,8' are supported by individual adjustable supports 9, 109 and by means of arms 10, 110.

Figure 15:
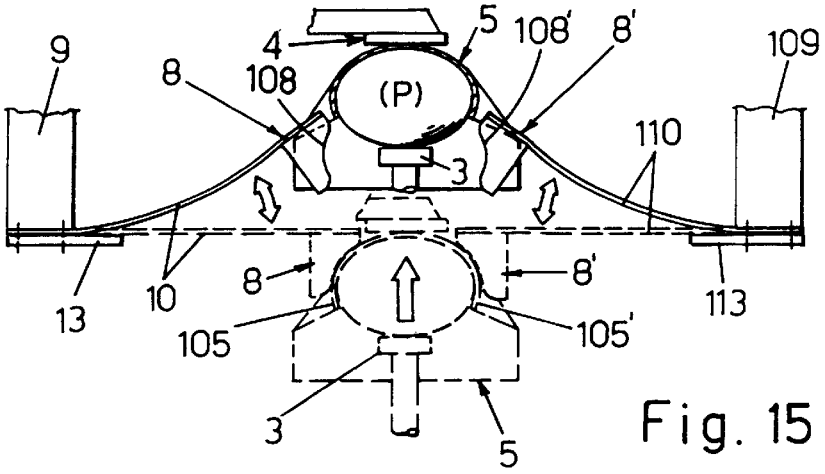
FIG. 15 is a front elevation of an alternative embodiment of the static folders of FIG. 12.
Figure 16:
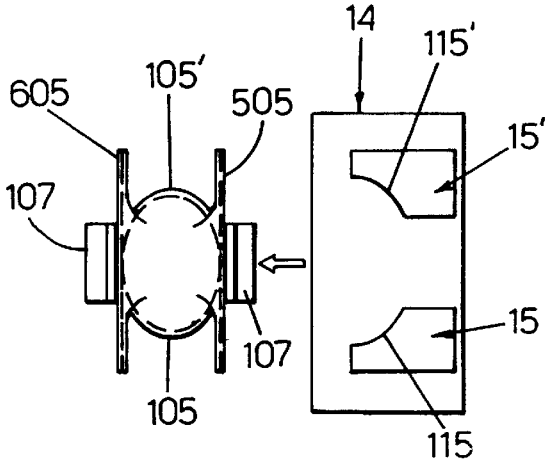
FIGS. 16 and 17 are a plan view from above and a lateral elevation, respectively, of the composite assembly of dynamic folders that operate in the first process station of the apparatus for the "p" fold of the wrapper and for folding a second pair of end portions of the wrapper.
Figure 18:
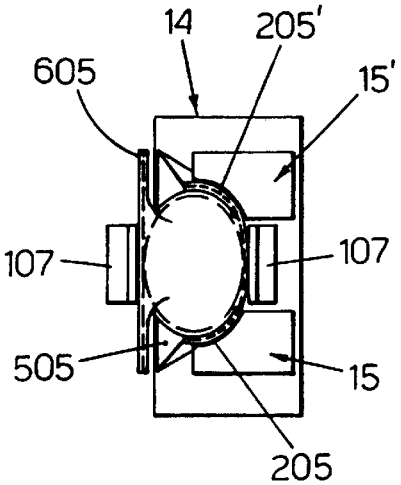
Figs 18 and 19 are a plan view from above and a lateral elevation, respectively, of the means shown in FIGS. 16 and 17, after the active processing stage.
Figure 17:
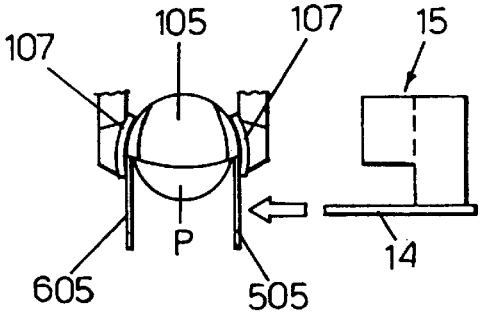
Figure 19:
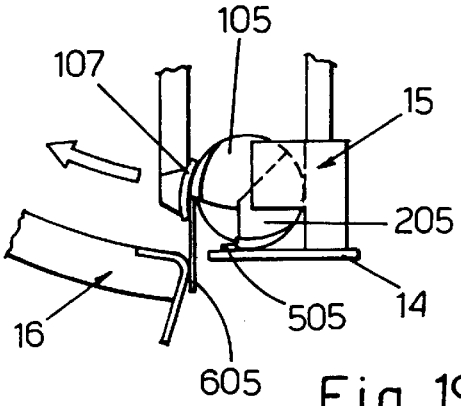

The variant shown in FIG. 15 shows that the folders 8, 8' can be such as to interfere in part with the ends of the product by means of their active surfaces 108, 108' in order to cause the wrapper to cling closely to the ends of said product. The active surfaces 108, 108' of the folders 8, 8' are in this case suitably concave and the folders themselves are designed to follow the product as it is lifted. The arms 10, 110 may be formed, for example, from strips of spring steel fixed to supports 9, 109 and may lie at rest on end-of-travel stops 13, 113.

After the product with its wrapper have been taken by the pincer 107 and abandoned by the lifter and complementary lifter, the known folder 14 intervenes with its added folders 15, 15', which fold the wrapper into a "p" and close a second portion 205, 205' of the end edges of the wrapper as illustrated in the series of FIGS. 16, 17, 18 and 19.

Figure 20:
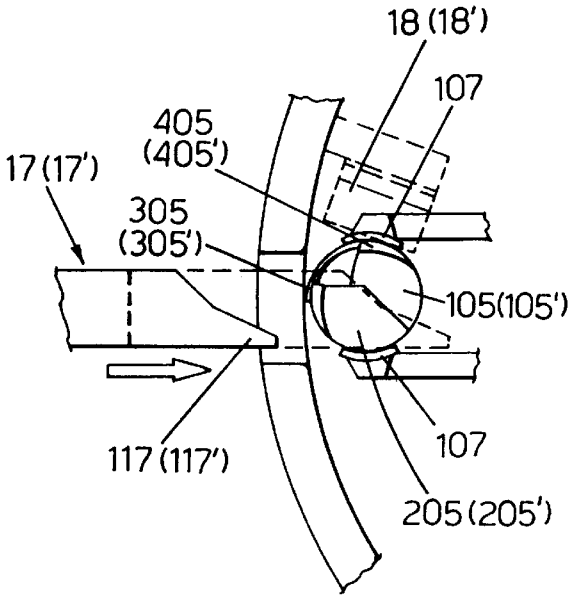
FIG. 20 is a lateral elevation of the second process station of the apparatus modified as in FIG. 12.
Figure 21:
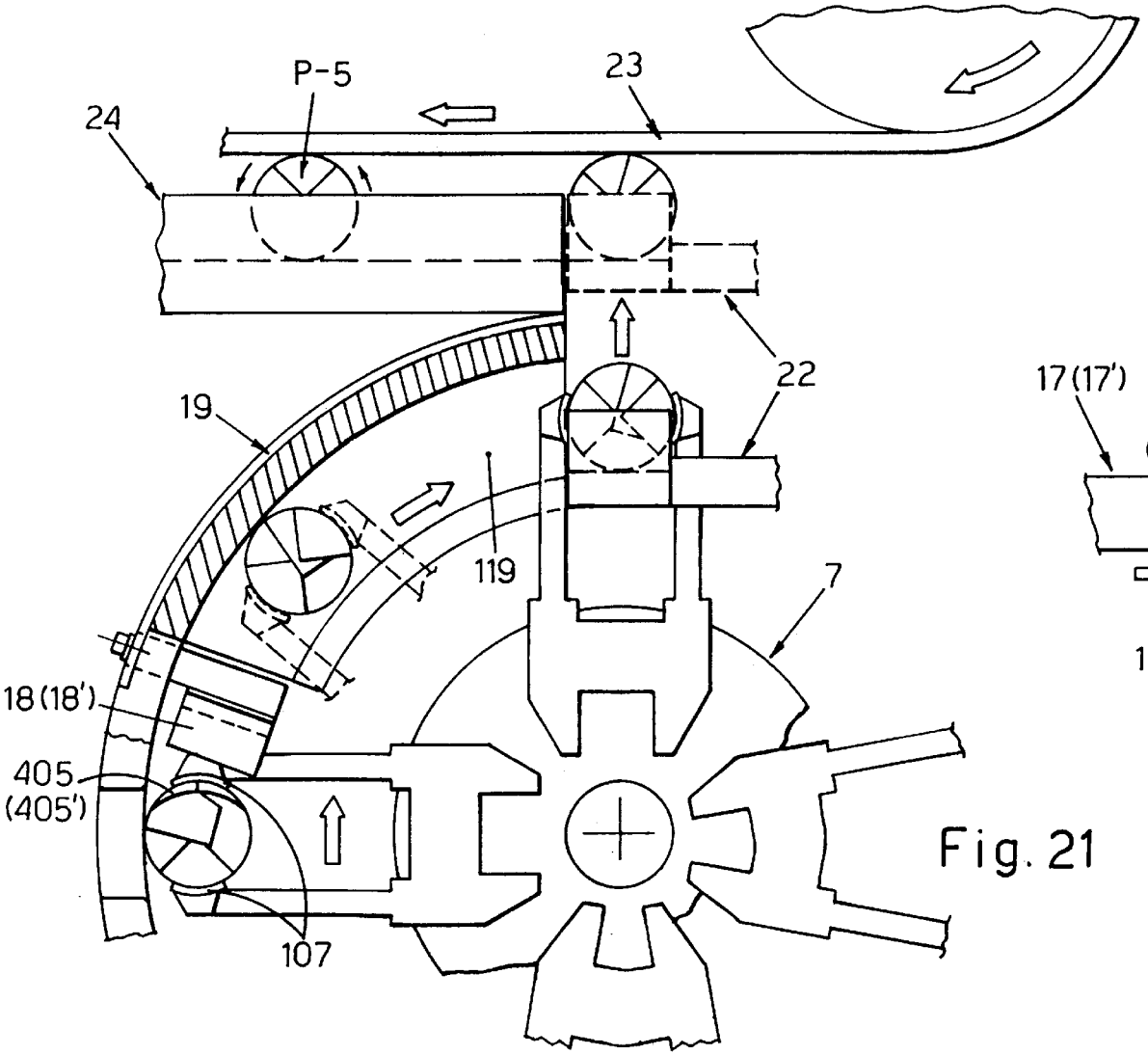
FIG. 21 is a lateral elevation, with parts in section, of the second and third process stations of the apparatus modified as in FIG. 12.

In the next stage the pincer rotates one step and reaches the second process station of the apparatus, as shown in FIGS. 20 and 21, where the pair of movable folders 17, 17' folds third portions 305, 305' of the end edges of the wrapper. As the product is then fed on towards the last process station, the static folders 18, 18' fold the fourth and last portions 405, 405' of the end edges of the wrapper, while the curved channel 19 keeps the wrapper correctly folded. It should be understood that the same applies to the folders 18, 18' and the channel 19 as was stated earlier with reference to FIG. 1. In another alternative embodiment, the folders 18, 18' may be separate from the curved channel 19, may be of the same type as the aforementioned type 8, 8' and may optionally be located upstream of the folders 17, 17'.

We claim:

1. A method for closing a wrapper about a product comprising the steps of:

positioning a wrapper over the product to be wrapped;

raising the product and superimposed wrapper such that two opposite downward-hanging edges of the wrapper are folded down about the product and hence the wrapper in profile has an inverted U shape about a longitudinal axis;

gripping the wrapper and product therebetween laterally;

folding one of the downward-hanging edges upwards against the product such that the wrapper has in profile a P shape with respective axial ends of the product open at each open end of the P shape and with the one of the downward-hanging edges having axially opposite end-most portions and axially opposite upward-extending portions extending therefrom;

at the same time as said folding the one downward-hanging edge step, folding each respective upward-extending portion of the one of the downward-hanging edges around the respective open axial ends of the product;

rotating the product and wrapper about a rotation axis parallel to the longitudinal axis such that the other downward-hanging edge is folded around the product and overlapping the respective end-most portions of the one of the downward-hanging edges such that the wrapper is laterally closed and defined;

folding each respective opposite longitudinal end of the other of the downward-hanging edges and the respective overlapped end-most portions axially against the respective axial ends of the product; and further rotating the product and wrapper about the rotation axis such that each respective portion of the wrapper between the respective longitudinal ends is folded around the respective axial ends of the product in an opposite direction to a direction of rotation to produce a wrapped product.

2. A method for closing a wrapper about a product as claimed in claim 1 wherein said first-mentioned rotating step and said further rotating step each rotate the product and wrapper about 90° around the rotation axis.

3. A method for closing a wrapper about a product as claimed in claim 1 wherein said further rotating step includes the step of engaging the respective opposite longitudinal ends of both downward-hanging edges and each respective opposite portion between the respective opposite longitudinal ends against a respective surface which is shaped to assure complete compaction of the respective ends and portions against the respective axial ends of the product.

4. A method for closing a wrapper about a product as claimed in claim 1 and further including the steps of:

raising the wrapped product away from the direction of rotation; and rolling of the wrapped product to assure that the wrapper clings uniformly and closely to the product.

5. A method for closing a wrapper about a product comprising the steps of:

positioning a wrapper over the product to be wrapped;

raising the product and superimposed wrapper such that two opposite downward-hanging edges of the wrapper are folded down about the product and hence the wrapper in profile has an inverted U shape about a longitudinal axis;

as the product and wrapper are being raised, folding arcuate middle portions of opposite longitudinal ends of the wrapper around respective axial ends of the product;

gripping the wrapper and product therebetween laterally;

folding one of the downward-hanging edges upwards against the product such that the wrapper has in profile a P shape and with the one of the downward-hanging edges having axially opposite end-most portions and axially opposite upward-extending portions extending therefrom;

at the same time as said folding the one downward-hanging edge step, folding each respective upward-extending portion of the one of the downward-hanging edges around the respective axial ends of the product;

rotating the product and wrapper about a rotation axis parallel to the longitudinal axis such that the other downward-hanging edge is folded around the product and overlapping the respective end-most portions of the one of the downward-hanging edges such that the wrapper is laterally closed and defined;

folding each opposite longitudinal end of the other of the downward-hanging edges and the respective overlapped end-most portions axially against the respective axial ends of the product; and further rotating the product and wrapper about the rotation axis such that each opposite remainder portion of the wrapper between the respective longitudinal ends of the other of the downward-hanging edge and the respective middle portions is folded around the respective axial ends of the product in an opposite direction to a direction of rotation to produce a wrapped product.

6. A method for closing a wrapper about a product as claimed in claim 5 wherein said first-mentioned rotating step and said further rotating step each rotate the product and wrapper about 90° around the rotation axis.

7. A method for closing a wrapper about a product as claimed in claim 5 wherein said further rotating step includes the step of engaging the respective opposite longitudinal ends of both downward-hanging edges, each respective middle portion, and each respective remainder portion against a respective surface which is shaped to assure complete compaction of the respective ends and portions against the respective axial ends of the product.

8. A method for closing a wrapper about a product as claimed in claim 5 and further including the steps of:

raising the wrapped product away from the direction of rotation; and rolling of the wrapped product to assure that the wrapper clings uniformly and closely to the product.

9. An apparatus for closing a wrapper about a product comprising:

a raising means for raising a product and a wrapper located centrally over the product;

a first folding means for folding the wrapper downwards about the product as said raising means raises the product and wrapper so that the wrapper has two opposite downward-hanging edges and hence the wrapper in profile has an inverted U shape about a longitudinal axis;

a gripping means for gripping the product and U shaped wrapper, said gripping means including pincers which grip the product and U shaped wrapper laterally, and a hub to which said pincers are attached which rotates about a rotation axis parallel to the longitudinal axis and hence which moves the product and wrapper along an orbit of motion;

a second folding means for folding one of the downward-hanging edges, said folding means including a forward edge which moves horizontally to move the one of the downward-hanging edges upwards against the product such that the wrapper has in profile a P shape with respective axial ends of the product open at each open end of the P shape and with the one of the downward-hanging edges having axially opposite end-most portions and axially opposite upward-extending portions extending therefrom, and a pair of opposing mirror-image folders located behind said forward edge and which move therewith to fold respective said upward-extending portions of the one of the downward-hanging edge around the respective open axial ends of the product;

an arcuate folder disposed adjacent the orbit of motion which, as the product and wrapper are rotated about the rotation axis along the orbit of motion, folds the other downward-hanging edge around the product and overlapping the respective end-most portions of the one of the downward-hanging edges such that the wrapper is laterally closed and defined;

a pair of dynamic folders located at an end of said arcuate folder which fold each respective opposite longitudinal end of the other of the downward-hanging edges and the respective overlapped end-most portions axially against the respective axial ends of the product; and a pair of static folders located along the orbit of motion downstream of said pair of dynamic folders which, as the product and wrapper are further rotated about the rotation axis along the orbit of motion, folds each respective unfolded portion of the wrapper between the respective longitudinal ends around the respective axial ends of the product in an opposite direction to the direction of rotation to produce a wrapped product.

10. An apparatus for closing a wrapper about a product as claimed in claim 9:

wherein each of said static folders is shaped to engage only the unfolded portion of the wrapper without engagement with an adjacent portion of the product.

11. An apparatus for closing a wrapper about a product as claimed in claim 9:

wherein each of said static folders is complementary shaped to an associated portion of the product such that each respective unfolded portion of the wrapper is folded closely against the product as the product and wrapper are moved along the orbit of motion.

12. An apparatus for closing a wrapper about a product as claimed in claim 9:

wherein said raising means includes a primary lifter which engages the product from below, a complementary lifter which engages the wrapper and product from above.

13. An apparatus for closing a wrapper about a product as claimed in claim 9:

further including, after said static folders, an arcuate channel made of a material with a low coefficient of friction and having an internal profile viewed along the orbit of motion which engages frictionally with portions of the wrapper adjacent the axial ends of the product.

14. An apparatus for closing a wrapper about a product as claimed in claim 13:

wherein said arcuate channel including shaped ends which form said static folders.

15. An apparatus for closing a wrapper about a product as claimed in claim 13:

wherein the internal profile of said arcuate channel is a C shape.

16. An apparatus for closing a wrapper about a product as claimed in claim 9:

wherein said dynamic folders are end members of said arcuate folder such that folding occurs as the product and wrapper are moved by said end members.

17. An apparatus for closing a wrapper about a product as claimed in claim 13 and further including:

a raising means for raising the wrapped product away from the orbit of motion at an exit end of said arcuate channel; and a rolling means for rolling of the wrapped product to assure that the wrapper clings uniformly and closely to the product.

18. An apparatus for closing a wrapper about a product as claimed in claim 9, and further including:

a second pair of second static folders adjacent said first folding means which folds arcuate middle portions of opposite longitudinal ends of the wrapper around respective axial ends of the product as the product and wrapper are being raised.

19. An apparatus for closing a wrapper about a product as claimed in claim 18:

wherein each of said first-mentioned static folders and second static folders is shaped to engage only the unfolded portion of the wrapper without engagement with an adjacent portion of the product.

20. An apparatus for closing a wrapper about a product as claimed in claim 18:

wherein each of said first-mentioned static folders is complementary shaped to an associated portion of the product such that each respective unfolded portion of the wrapper is folded closely against the product as the product and wrapper are moved along the orbit of motion;

wherein each of said second static folders is complementary shaped to an associated portion of the product such that each respective unfolded portion of the wrapper is folded closely against the product; and further including a moving means for moving said second static folders (a) from an initial position, (b) to engagement with a respective middle portion and finally to where the middle portions are folded closely against the product as said raising means raises the product, and (c) back to the initial position.

21. An apparatus for closing a wrapper about a product as claimed in claim 20:

wherein said moving means includes for each second static folder a support, a flexible arm attaching said second static folder to said support, and a stop which stabilizes said flexible arm at a rest position.

22. An apparatus for closing a wrapper about a product as claimed in claim 21:

wherein each said flexible arm is a leaf spring.

23. An apparatus for closing a wrapper about a product as claimed in claim 18:

wherein said raising means includes a primary lifter which engages the product from below, a complementary lifter which engages the wrapper and product from above.

24. An apparatus for closing a wrapper about a product as claimed in claim 18:

further including, after said first-mentioned static folders, an arcuate channel made of a material with a low coefficient of friction and having a profile viewed along the orbit of motion which engages frictionally with portions of the wrapper adjacent the axial ends of the product.

25. An apparatus for closing a wrapper about a product as claimed in claim 24:

wherein said arcuate channel including shaped ends which form said first-mentioned static folders.

26. An apparatus for closing a wrapper about a product as claimed in claim 24:

wherein the internal profile of said arcuate channel is a C shape.

27. An apparatus for closing a wrapper about a product as claimed in claim 18:

wherein said dynamic folders are end members of said arcuate folder such that folding occurs as the product and wrapper are moved by said end members.

28. An apparatus for closing a wrapper about a product as claimed in claim 24 and further including:

a raising means for raising the wrapped product away from the orbit of motion at an exit end of said arcuate channel; and a rolling means for rolling of the wrapped product to assure that the wrapper clings uniformly and closely to the product.

* * * * *